US010308053B2

(12) United States Patent
Hirose

(10) Patent No.: US 10,308,053 B2
(45) Date of Patent: Jun. 4, 2019

(54) PRINTER FOR PRINTING ON A PRINT MEDIUM TEMPORARILY ADHERED TO A BELT-SHAPED MOUNT

(71) Applicant: SATO HOLDINGS KABUSHIKI KAISHA, Tokyo (JP)

(72) Inventor: Kenji Hirose, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/508,601

(22) PCT Filed: Apr. 8, 2015

(86) PCT No.: PCT/JP2015/060952
§ 371 (c)(1),
(2) Date: Mar. 3, 2017

(87) PCT Pub. No.: WO2016/121137
PCT Pub. Date: Aug. 4, 2016

(65) Prior Publication Data

US 2017/0274685 A1 Sep. 28, 2017

(30) Foreign Application Priority Data

Jan. 29, 2015 (JP) ..... 2015-015245

(51) Int. Cl.
*B65C 9/18* (2006.01)
*B41J 15/04* (2006.01)
(Continued)

(52) U.S. Cl.
CPC ..... *B41J 15/042* (2013.01); *B41J 3/4075* (2013.01); *B41J 29/02* (2013.01); *B41J 29/13* (2013.01); *B65C 9/18* (2013.01)

(58) Field of Classification Search
CPC ..... B41J 15/042; B41J 3/4075; B41J 29/13; B65C 9/18
See application file for complete search history.

(56) References Cited

U.S. PATENT DOCUMENTS

2006/0151118 A1* 7/2006 Murata ..... B41J 3/4075 156/379
2006/0165467 A1 7/2006 Kawakami et al.
(Continued)

FOREIGN PATENT DOCUMENTS

EP 1 679 199 A2 7/2006
JP 2004-42431 A 2/2004
(Continued)

*Primary Examiner* — Bradley W Thies
(74) *Attorney, Agent, or Firm* — Foley & Lardner LLP

(57) ABSTRACT

A printer according to the present invention includes a container configured to contain a roll body into which the belt-shaped mount is wound; an opening and closing cover configured to open or close the container; and a switching unit configure to be movable between a first position and a second position. When the switching unit is at the first position, printing is performed with the first ejection mode. When the switching unit is at the second position, printing is performed with the second ejection mode. A portion of the opening and closing cover contacts the switching unit so that the switching unit moves in a direction toward the second position, in response to a status change of the opening and closing cover from an opened status to a closed status.

17 Claims, 15 Drawing Sheets

(51) Int. Cl.

| | |
|---|---|
| ***B41J 29/02*** | (2006.01) |
| ***B41J 29/13*** | (2006.01) |
| ***B41J 3/407*** | (2006.01) |

(56) References Cited

U.S. PATENT DOCUMENTS

| | | | |
|---|---|---|---|
| 2010/0178094 | A1 | 7/2010 | Kawakami et al. |
| 2013/0108346 | A1 | 5/2013 | Preliasco et al. |
| 2016/0318317 | A1 | 11/2016 | Preliasco et al. |

FOREIGN PATENT DOCUMENTS

| | | | | |
|---|---|---|---|---|
| JP | 2006-39170 | A | | 2/2006 |
| JP | 2006-150858 | A | | 6/2006 |
| JP | 2011-53333 | A | | 3/2011 |
| JP | 2012-176498 | A | | 9/2012 |
| JP | 2012176498 | A | * | 9/2012 |

* cited by examiner

S1

S2

S3

S4

S5

S4

S5

S4

S5

PRINTER FOR PRINTING ON A PRINT MEDIUM TEMPORARILY ADHERED TO A BELT-SHAPED MOUNT

TECHNICAL FIELD

The present invention relates to a printer, e.g., a label printer configured to print desired information, such as letters, symbols, graphics, barcodes, or the like on a label temporarily adhering to a mount and having a separation ejection function to separate the label from the mount and eject the same.

BACKGROUND ART

A label printer includes a thermal head and a platen roller. The label printer pinches one end in the longitudinal direction of a continuous paper wound into a roll between the thermal head and the platen roller, and rotates the platen roller to feed the continuous paper in a sheet shape. During this feeding, the thermal head in this label printer prints desired information on each of a plurality of labels temporarily adhering to a long strip of mount included in the continuous paper.

There are two types of ejection schemes for such label printer, that is, continuous ejection and separation ejection. The continuous ejection is to eject labels while leaving the labels temporarily adhering to a mount. The separation ejection is to separate labels from a mount and then eject the same.

In the case of the continuous ejection, the operator cuts off a mount having a required number of labels attached thereon from a continuous paper. Then the operator can bring this cut-off mount to the site, and can separate the labels from the mount for attachment at the site. The continuous ejection is therefore suitable for the case where a target for attachment of the labels is located in a place away from the printer.

Meanwhile in the case of the separation ejection, the printer ejects labels separated from a mount one by one. The separation ejection is therefore suitable for the case where a target for attachment of the labels is located near the operator. With regard to the separation ejection, a switching unit attached to the printer is set at the separation ejection position. Then one end in the longitudinal direction of the mount is bent via a separation pin, and the one end is pinched between a separation roller of the switching unit and a platen roller. Thereby, when the continuous paper is fed for printing by rotating the platen roller, the mount is fed while being pinched between the separation roller and the platen roller. During the feeding, the printed labels are separated from the mount one by one and are ejected from the printer.

As an example of a printer having the two types of ejection modes including the continuous ejection and the separation ejection, the printer described in Japanese laid-open patent publication JP 2004-42431 is known, for example.

SUMMARY OF THE INVENTION

Problems to be Solved by the Invention

In the conventional printer in which an ejection mode is changeable, a switching unit (a movable body 11 in the patent publication described above, for example) may be movable between a continuous ejection position and a separation ejection position. However, there is a drawback that, in such conventional printer, the switching unit may not be able to be properly set at the continuous ejection position. When the switching unit is not able to be properly set at the continuous ejection position, a problem arises in function(s) of the printer.

For example, such problem may be that an opening and closing cover of the printer cannot be closed, or that, even when the opening and closing cover of the printer can be closed, a mount cannot be cut with a cutter of the printer. When a separation roller of the switching unit is not located properly, presence or absence of the separation roller may not be able to be detected by a sensor. That is, in a case where a system is applied in which a continuous ejection mode or a separation ejection mode is determined based on a sensor result of whether the separation roller of the switching unit is at a predetermined position or not, a problem may arise that presence or absence of the separation roller is not detected properly and an ejection mode of the printer cannot be determined properly.

In view of the technical background as described above, the present invention aims to provide a printer capable of surely switching from a first ejection mode in which a printed print medium is separated from a mount, to a second ejection mode in which a printed medium is not separated from the mount.

Means for Solving the Problems

A first aspect of the present invention is a printer feeding a belt-shaped mount to which a print medium temporarily adheres, the printer being selectable from a first ejection mode in which a printed print medium is separated from the belt-shaped mount, and a second ejection mode in which a printed print medium is not separated from the belt-shaped mount. The printer includes: a container configured to contain a roll body into which the belt-shaped mount is wound; an opening and closing cover configured to open or close the container; and a switching-unit configure to be movable between a first position and a second position. When the switching unit is at the first position, printing is performed with the first ejection mode. When the switching unit is at the second position, printing is performed with the second ejection mode. A portion of the opening and closing cover contacts the switching unit so that the switching unit moves in a direction toward the second position, in response to a status change of the opening and closing cover from an opened status to a closed status.

In a second aspect of the present invention, the portion of the opening and closing cover contacts the switching unit so that the switching unit moves in a direction from an incomplete second position toward the second position, in response to the status change of the opening and closing cover from the opened status to the closed status.

A third aspect of the present invention is a printer further including a pair of holders configured to be capable of holding the switching unit at the second position. The switching unit includes a pair of supporters, and the incomplete second position is a position in which only one of the pair of supporters is held at the second position.

In a fourth aspect of the present invention, the switching unit includes an inclined surface that is inclined in a direction from the incomplete second position to the second position, and the portion of the opening and closing cover contacts the inclined surface while the opening and closing cover rotates in association with the status change of the opening and closing cover from the opened status to the closed status, thereby moving the switching unit in the above direction.

In a fifth aspect of the present invention, the portion of the opening and closing cover continues to contact the inclined surface until the switching unit reaches the second position.

In a sixth aspect of the present invention, each of the pair of supporters includes a recess, and each of the pair of holders includes a claw engaging with the recess.

A seventh aspect of the present invention is a printer further including a platen roller configured to feed the belt-shaped mount. The platen roller is attached to the opening and closing cover. The portion of the opening and closing cover is in the vicinity of the both ends of the platen roller.

Effect of the Invention

The printer according to the present invention is capable of surely switching from a first ejection mode in which a printed print medium is separated from a mount, to a second ejection mode in which a printed medium is not separated from the mount.

DETAILED DESCRIPTION OF THE INVENTION

Figure 1A:
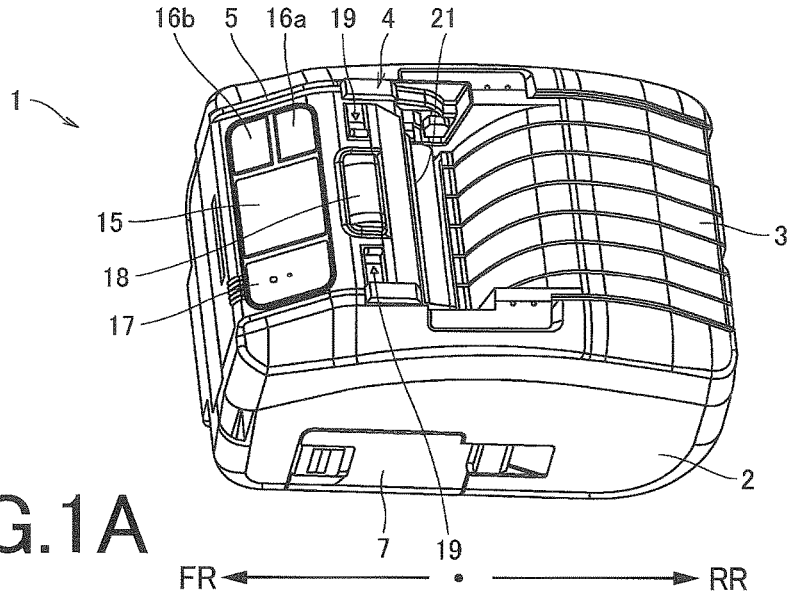
FIG. 1A is an overall perspective view of a printer according to the present embodiment in the continuous ejection mode.

The present invention relates to Japanese Patent Application No. 2015-15245, filed on Jan. 29, 2015, the entire contents of which are incorporated herein by reference.

The following describes one embodiment of the present invention in details with reference to the drawings. In the drawings to describe the embodiment, the same reference numerals are basically assigned to the corresponding elements, and the repeated descriptions therefor are omitted.

Figure 1B:
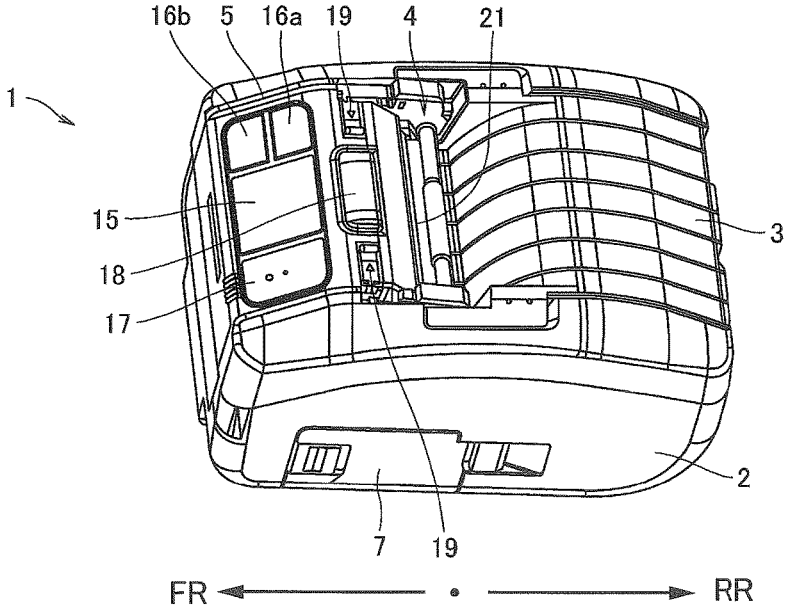
FIG. 1B is an overall perspective view of a printer according to the present embodiment in the separation ejection mode.
Figure 2:
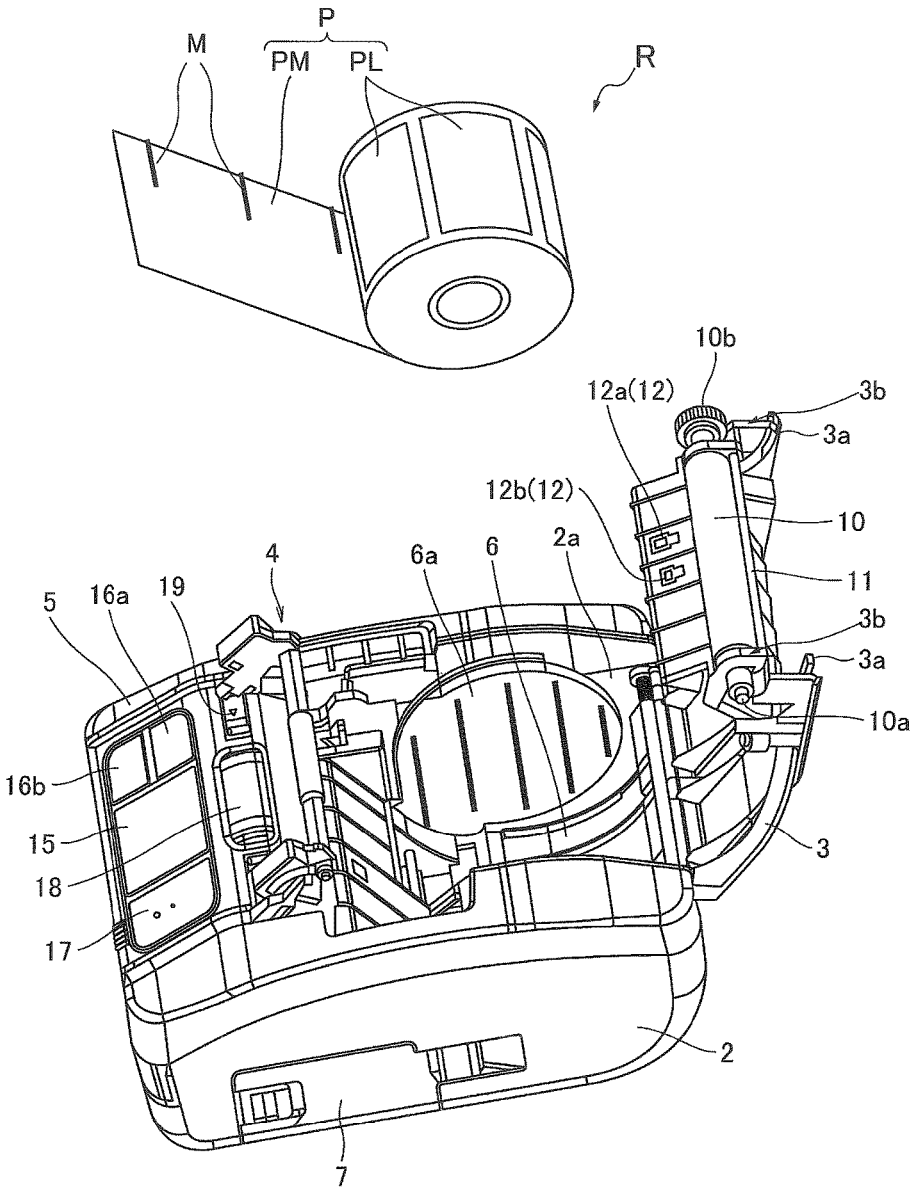
FIG. 2 is an overall perspective view showing the appearance of the printer of FIGS. 1A and 1B when an opening and closing cover is opened, and a paper roll.
Figure 3:
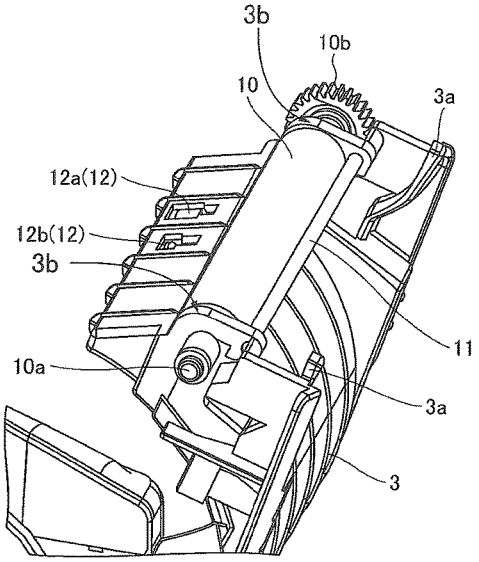
FIG. 3 is a perspective view showing the major components of the opening and closing cover of the printer of FIGS. 1A and 1B.

FIG. 1A is an overall perspective view of a printer according to the present embodiment in the continuous ejection mode. FIG. 1B is an overall perspective view of a printer according to the present embodiment in the separation ejection mode. FIG. 2 is an overall perspective view showing the appearance of the printer of FIGS. 1A and 1B when an opening and closing cover is opened, and a paper roll. FIG. 3 is a perspective view showing the major components of the opening and closing cover of the printer of FIGS. 1A and 1B.

As shown in FIGS. 1A and 1B, the printer 1 of the present embodiment is a portable label printer that has a flat cuboid shape, for example. This printer 1 includes a body case 2, an opening and closing cover 3, a switching unit 4, and a front cover 5. The printer 1 can be switched between a continuous ejection mode and a separation ejection mode, i.e., is configured as a double-function type. The printer 1 can be used with its outlet directed upward (transverse posture). The printer 1 can be used with a belt hook (not illustrated) on the bottom of the printer 1 hanging from a belt of the operator, or can be used with a shoulder belt (not illustrated) hanged on the shoulder of the operator so as to place the outlet laterally (placing it vertically).

In the following description, a direction along the long side of the printer 1 having a cuboid shape is defined as a longitudinal direction. A side of the printer 1 on which a display unit 15, which will be described later, is disposed, is defined as a front side (FR), while the opposite side thereof is defined as a rear side (RR).

Assume that the printer 1 is located on a flat plane. In the following description, a section view, which will be referred to as appropriate, indicates a section in a case in which the printer 1 is cut with a plane orthogonal to that flat plane and along the longitudinal direction.

The body case 2 is a housing that defines a part of the outer shape of the printer 1. On one face of the body case 2, an opening 2*a* is formed as shown in FIG. 2. In this opening 2*a*, a paper container 6 is disposed. The paper container 6 is a region in which a paper roll R is contained. Inside of the paper container 6, a paper guide 6*a* is disposed. The paper guide 6*a* is configured to rotatably support a paper roll R while coming in contact with both end faces of the paper roll R in the width direction, so as to guide a continuous paper extracted from the paper roll R while being fed. The paper guide 6*a* is movably disposed along the transverse direction of the paper roll R so as to change its position in accordance with the width of the paper roll R.

As shown in FIG. 2, the paper roll R is an example of a roll body. A belt-shaped long strip of continuous paper P is wound into the paper roll R. The belt-shaped continuous paper P includes a belt-shaped mount PM and a plurality of labels PL (an example of a print medium) temporarily adhering to the mount PM with predetermined intervals.

The label attaching face of the mount PM is coated with a parting agent such as silicone for facilitating separation of the labels PL. On the rear face of the label attaching face of the mount PM, location detection marks M indicating the locations of the labels PL are formed with predetermined intervals.

The front face of the label PL is a print surface on which information is printed. A thermosensitive color developing layer is formed on the front face of the label PL. When the temperature reaches a predetermined range, the thermosensitive color developing layer develops a specific color. The rear face of the print surface is an adhesion surface on which an adhesive agent is coated. The adhesion surface is attached to the label attaching face of the mount PM, and thereby the labels PL temporarily adhere to the mount PM.

The printer 1 according to the present embodiment feeds the mount PM to which the labels PL temporarily adhere. One of a separation ejection mode (an example of a first ejection mode) and a continuous ejection mode (an example of a second ejection mode) can be selectively set for the printer 1. In the separation ejection mode, the printer 1 separates the printed label PL from the mount PM before ejecting the same. In the continuous ejection mode, the printer 1 does not separate the printed label(s) PL from the mount PM and continuously ejects the same.

As shown in FIGS. 1A, 1B and 2, a battery cover 7 is pivotally supported openably and closably on the lateral face of the body case 2. The battery cover 7 is an opening and closing cover of a battery container described later (not illustrated in FIGS. 1A to 3).

The opening and closing cover 3 is a cover for opening and closing the paper container 6. In order to allow the front end of the opening and closing cover 3 to swing in a direction away and closer to the body case 2, the rear end of the opening and closing cover 3 is pivotally supported at the rear end part of the body case 2 via a hinge. The opening and closing cover 3 is biased to the opening direction (the direction in which the front end of the opening and closing cover 3 swings away from the body case 2) with a torsion spring (not illustrated in FIGS. 1A to 3) disposed at the rear end of the opening and closing cover 3.

As shown in FIGS. 2 and 3, a pair of pressing parts 3*a* is disposed at the front end of the opening and closing cover 3. The pair of pressing parts 3*a* is configured to press the switching unit 4 so as to fix the switching unit 4 at a separation ejection position when the opening and closing cover 3 is closed in the separation ejection mode. The pair of pressing parts 3*a* is disposed on both ends in the width direction of the opening and closing cover 3.

As shown in FIGS. 2 and 3, a platen roller (which is also referred to as a feed roller) 10 is pivotally supported at the front end of the opening and closing cover 3 so that the roller can rotate in a forward direction and a reverse direction. The platen roller 10 is feed means configured to feed the continuous paper P extracted from the paper roll R. The platen roller 10 extends in the width direction of the continuous paper P. The platen roller 10 has a platen shaft 10*a*, and a gear 10*b* is connected to one end of the platen shaft 10*a*. The gear 10*b* engages with a gear (not illustrated) or the like disposed in the opening 2*a* when the opening and closing cover 3 is closed. Via that gear disposed in the opening 2*a*, the gear 10*b* is mechanically connected to a stepping motor (not illustrated) or the like for driving the roller.

A pair of unit contact portions 3*b* is formed in the vicinity of the both ends of the platen roller 10 which is pivotally supported by the opening and closing cover 3. As will be described later, the pair of unit contact portions 3*b* contacts a pair of inclined surfaces 4*cs* (which will be described later) and serves to assist the switching unit 4 to be set at the continuous ejection position.

As illustrated in FIGS. 2 and 3, a separation pin 11 is disposed at the opening and closing cover 3 along the platen roller 10 and in the vicinity of the platen roller 10. The separation pin 11 is a separation member configured to separate the label PL from the mount PM. Both ends of the separation pin 11 are pivotally supported at the opening and closing cover 3.

As illustrated in FIGS. 2 and 3, sensors 12*a*, 12*b* (which are collectively referred to as "sensor 12") are disposed on a portion of the opening and closing cover 3 in the vicinity of the platen roller 10. More specifically, the sensors 12*a*, 12*b* are disposed on a surface of the opening and closing cover 3 facing a feeding path when the opening and closing cover 3 is closed. The sensor 12*a* is configured to detect a reference position of the label PL (namely, the location detection mark M of the mount PM). The sensor 12*a* is a reflective type optical sensor. The sensor 12*b* is configured to detect presence or absence of the label PL (in other words, detect a portion of the mount PM to which the label PL adheres and a portion to which the label PL does not adhere). The sensor 12*b* is a thru-beam type optical sensor, for example.

The switching unit 4 is set at the separation ejection position (an example of a first position) in the separation ejection mode, and is set at a continuous ejection position (an example of a second position) in the continuous ejection mode. The switching unit 4 can move between the continuous ejection position and the separation ejection position.

In the case of the separation ejection mode of the printer 1, the switching unit 4 has a function of changing a feeding direction of the mount PM to which a printed label PM temporarily adheres and a function of separating the printed label PM from the mount PM. In other words, in the separation ejection mode, the switching unit 4 has a function of peeling off the printed label PL from the mount PM, and a function of diverging feeding paths of the mount PM and the label PL at the downstream side from the platen roller 10. With the switching unit 4, the feeding direction of the mount PM is changed to a direction different from that of the label PL (that is, a direction toward a separation roller 4*a*, which will be described later), thereby separating the label PM from the mount PM.

The configuration of the switching unit 4 will be described later.

As shown in FIGS. 1A, 1B and 2, the front cover 5 is fixed to the body case 2 so as to cover a part of the upper face of the printer 1 other than the opening and closing cover 3. A display unit 15, operation buttons 16*a*, 16*b*, a power-supply button 17, a cover-open button 18, a pair of release levers 19 and a cutter 21 are disposed on the front cover 5.

The display unit 15 is a screen for displaying an operation command, a message or the like. The display unit 15 includes a liquid crystal display (LCD), for example. The operation buttons 16*a*, 16*b* are configured to manipulate the operation of the printer 1. The power-supply button 17 is configured to turn on or off a power supply of the printer 1.

The cover-open button 18 is configured to open the opening and closing cover 3. Although not shown in FIGS. 1A, 1B and 2, a pair of coil springs 20 is provided to respectively bias the pair of the release levers 19 inward. When the pair of the release levers 19 is moved closer to each other against a biasing force of the pair of coil springs 20, it becomes possible to cancel a status in which the switching unit 4 is set at the continuous ejection position and to set the switching unit 4 at the separation ejection position.

The cutter 21 is configured to cut the mount PM of the continuous paper P that has been continuously ejected. The cutter 21 is disposed at the front end of the front cover 5 on the opposite side of the opening and closing cover 3. The cutter 21 extends along the width direction of the continuous paper P. An outlet is formed between the opening and closing cover 3 and the front cover 5.

Figure 4:
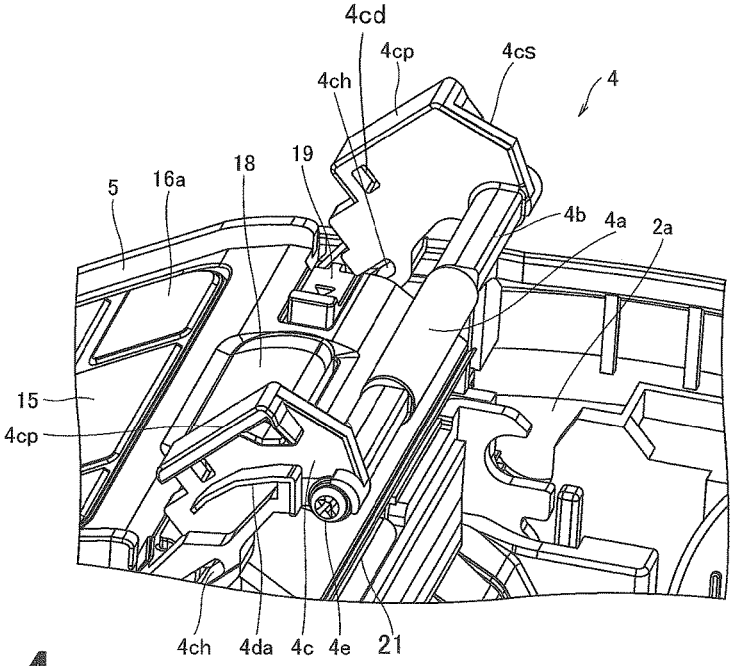
FIG. 4 is an enlarged perspective view of a switching unit of the printer in FIG. 2 and the surrounding major components.
Figure 5:
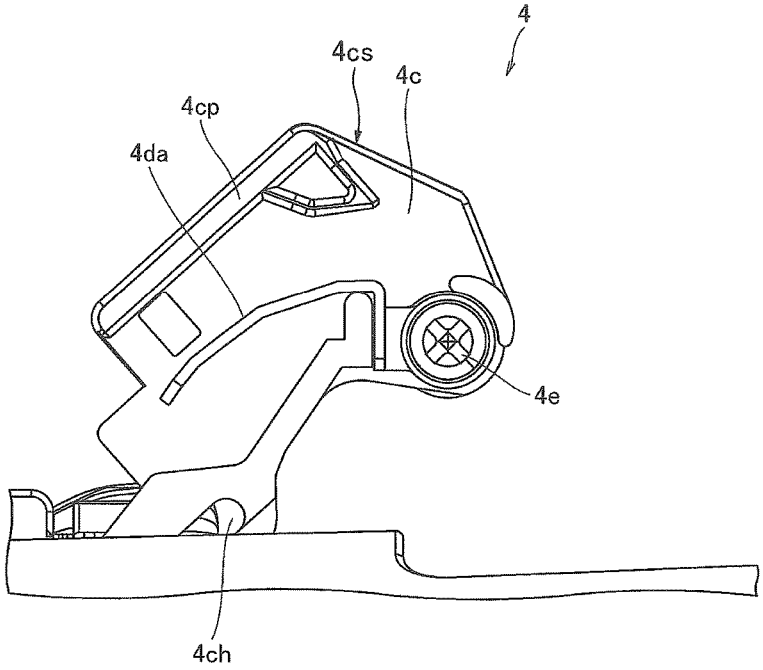
FIG. 5 is a lateral view showing the major components of the switching unit in FIG. 4.
Figure 6A:
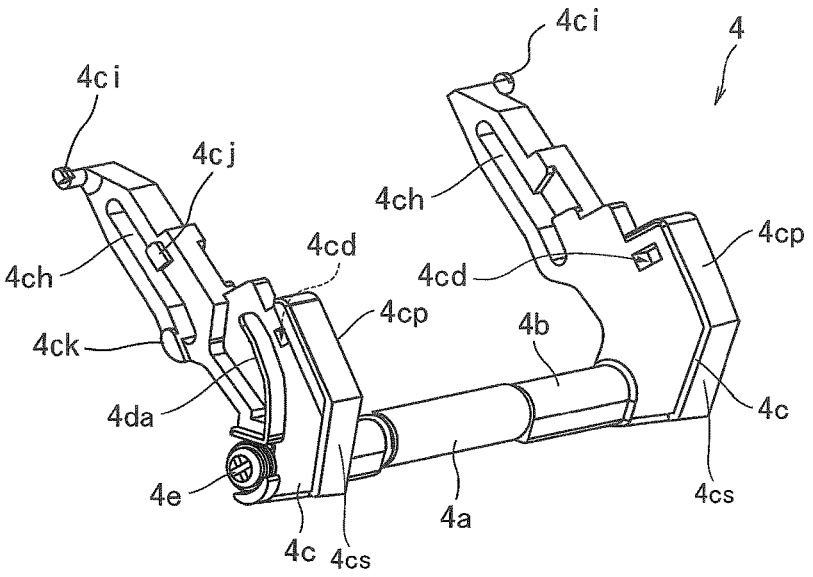
FIG. 6A is an overall perspective view showing the switching unit in FIG. 4 that is extracted.
Figure 6B:
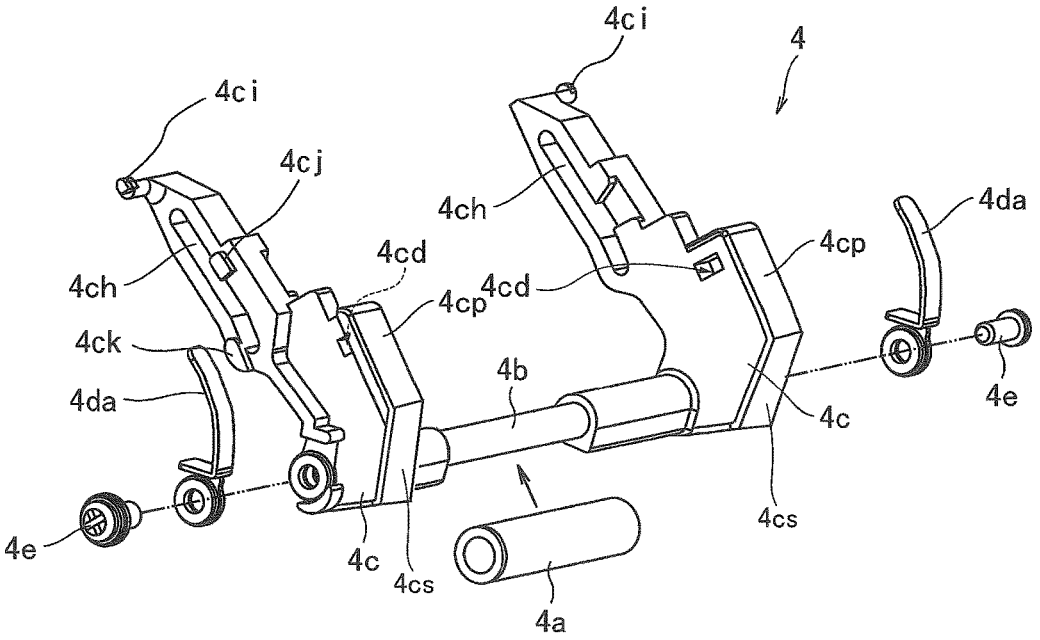
FIG. 6B is an exploded perspective view of the switching unit and the label guide member in FIG. 6A.

The following describes the switching unit 4 with reference to FIGS. 4 to 6B. FIG. 4 is an enlarged perspective view of the switching unit and a label guide member of the printer in FIG. 2 and the surrounding major components. FIG. 5 is a lateral view showing the major components of the switching unit in FIG. 4. FIG. 6A is an overall perspective view showing the switching unit and the label guide member in FIG. 4 that are extracted. FIG. 6B is an exploded perspective view of the switching unit and the label guide member in FIG. 6A.

The switching unit 4 includes a separation roller 4*a*, a shaft 4*b*, a pair of supporters 4*c*, a pair of plate springs 4*da* and screws 4*e*.

When the switching unit 4 is set at the separation ejection position, the separation roller 4*a* is located so as to be on a side spaced apart from the thermal head 28 with respect to the platen roller 10 and face the platen roller 10. Therefore, the mount PM inserted between the separation roller 4*a* and the platen roller 10 is fed while being pinched between the separation roller 4*a* and the platen roller 10.

The separation roller 4*a* is made of an elastic member such as rubber. The separation roller 4*a* is pivotally and rotatably supported at the shaft 4*b* that is sandwiched between the pair of supporters 4*c*. The separation roller 4*a* has a length that is shorter than the overall length of the shaft 4*b*. The separation roller 4*a* is located roughly at the center in the axial direction of the shaft 4*b*. In the separation ejection mode, the separation roller 4*a* is located so as to be on a side spaced apart from the thermal head 28, which will be described later, with respect to the platen roller 10. When the separation roller 4*a* is pressed toward the platen roller 10 via the continuous paper P in the separation ejection mode, the separation roller 4*a* is driven by the platen roller 10, while pinching the mount PM from which the label PL is separated, with the platen roller 10.

The pair of supporters 4*c* is configured to support the separation roller 4*a* and the shaft 4*b*. An eave 4*cp* is formed at an upper part on each supporter 4*c*. The eave 4*cp* extends outwardly from a lateral face of each supporter 4*c*. As illustrated in FIG. 6A, a guide rail hole 4*ch* is formed on the front side of each supporter 4*c*. The guide rail hole 4*ch* is configured to guide and restrict the movement of the switching unit 4. The guide rail hole 4*ch* is a long hole along the longitudinal direction of the supporter 4*c*.

A pair of inclined surfaces 4*cs* is formed respectively at the rear end of the pair of supporters 4*c*. Each of the pair of inclined surfaces 4*cs* extends from the eave 4*cp*. Each of the pair of inclined surfaces 4*cs* is inclined to a direction from the separation ejection position to the continuous ejection position of the switching unit 4, i.e. a direction from the rear end to the front end of the guide rail hole 4*ch*. As will be described later, the pair of inclined surfaces 4*cs* serves to assist the switching unit 4 to be set at the continuous ejection position, in cooperation with the unit contact portion 3*b* of the opening and closing cover 3, when one intends to set the switching unit 4 at the continuous ejection position.

Each of the pair of supporters 4*c* includes a recess 4*cd*. The recess 4*cd* engages with a claw 19*a* of the release lever 19 when the switching unit 4 is located at the continuous ejection position. With the recess 4*cd* engaging with the claw 19*a* of the release lever 19, the supporter 4*c* is held by the release lever 19, thereby setting the switching unit 4 at the continuous ejection position.

As details will be described later, a shaft (one example of a swing axis) 42 attached to a support board 41 is inserted into the guide rail holes 4*ch*, thereby fixing the switching unit 4 to the support board 41. Although a pair of shafts 42 is provided in accordance with the pair of supporters 4*c* in the present embodiment, a single shaft may be provided instead. Alternatively, in place of the shaft(s), protrusions that act like a swing axis may be also applied.

The pair of plate springs 4*da* is an elastic structure that comes into contact with the pressing parts 3*a* of the opening and closing cover 3 so as to bias the separation roller 4*a* toward the platen roller 10 in response to the closure of the opening and closing cover 3, while the switching unit 4 moves to the separation ejection position. At an outer lateral face of each supporter 4*c*, each plate spring 4*da* is fixed at the rear side of the supporter 4*c* (namely, the side on which the separation roller 4*a* is disposed), and extends therefrom in a curve toward the front side of the supporter 4*c* (namely, the side on which the guide rail hole 4*ch* is disposed). The terminal end of each plate spring 4*da* floats.

Figure 7:
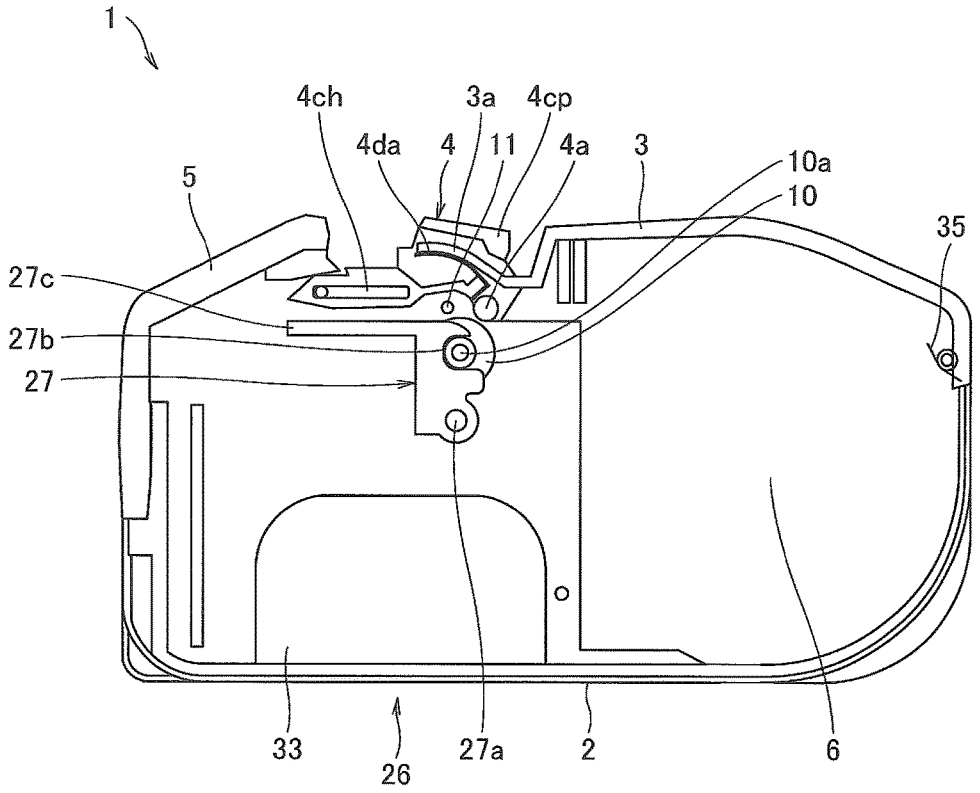
FIG. 7 is a schematic section view of the inside of the printer in the separation ejection mode of FIGS. 1A and 1B as seen through the lateral face side.
Figure 8A:
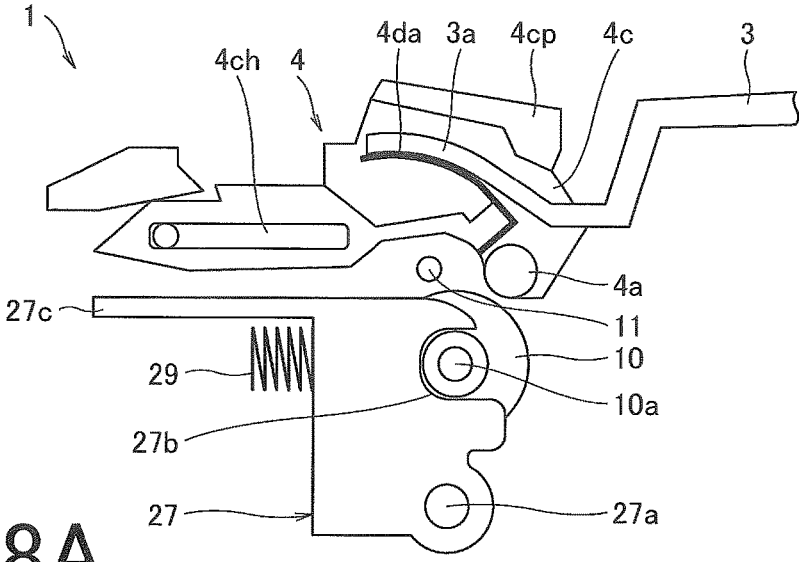
FIG. 8A is an enlarged schematic section view of the major components of the printer of FIG. 7.
Figure 8B:
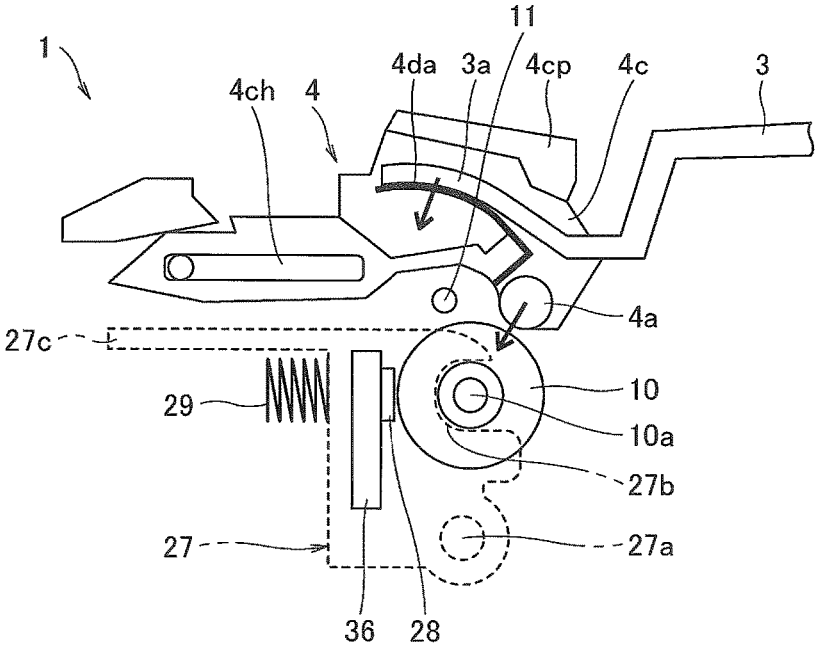
FIG. 8B is an enlarged schematic section view of the major components of the printer of FIG. 7.

Next, the internal configuration of the printer 1 will be described with reference to FIGS. 7, 8A and 8B. FIG. 7 is a schematic section view of the inside of the printer in the separation ejection mode of FIGS. 1A and 1B as seen through the lateral face side. FIG. 8A is an enlarged schematic section view of the major components of the printer of FIG. 7. FIG. 8B is an enlarged schematic view similar to FIG. 8A and shows an action of the pressing parts 3*a* of the opening and closing cover 3.

As illustrated in FIG. 7, a printing unit 26 is disposed adjacent to the paper container 6 in the opening 2*a* of the body case 2. The printing unit 26 is configured to print on the label PL of the paper roll R. The printing unit 26 includes a head bracket 27, a thermal head (one example of a print head) 28 (see FIG. 8B), a coil spring 29 (see FIG. 8B), the switching unit 4 and a battery container 33 (see FIG. 7).

The head bracket 27 is configured to hold the opening and closing cover 3 when the opening and closing cover 3 is closed. The head bracket 27 is disposed in the body case 2 on the opposite side of the platen roller 10 when the opening and closing cover 3 is closed, so as to swing about a rotating shaft 27*a*. The head bracket 27 has a groove 27*b*. The platen shaft 10*a* of the platen roller 10 is fitted into the groove 27*b* so that the head bracket 27 holds the opening and closing cover 3.

The head bracket 27 has a pressing part 27*c*. The pressing part 27*c* is disposed at a position opposed to the cover-open button 18 illustrated in FIGS. 1A and 1B (specifically, a position immediately below the cover-open button 18). When the cover-open button 18 is pressed, the pressing part 27*c* is also pressed, thereby cancelling the holding of the opening and closing cover 3 by the head bracket 27. After the holding of the opening and closing cover 3 is cancelled, the opening and closing cover 3 will open automatically by a biasing force of a torsion spring 35 (see FIG. 7) that is disposed on the rear end of the opening and closing cover 3.

The thermal head 28 (see FIG. 8B) is print means to print information such as letters, symbols, graphics, barcodes, or the like on the label PL adhering to the mount PM extracted from the paper roll R. The thermal head 28 is mounted at the head bracket 27 via a circuit board 36. The thermal head 28 faces the platen roller 10 and the print face of the thermal head 28 faces the feeding path, when the opening and closing cover 3 is closed. On the print face of the thermal head 28, a plurality of heater resistors (heater elements) that generate heat when applying current are arranged along the width direction of the continuous paper P. The circuit board 36 is a wiring board configured to transmit print signals to the thermal head 28.

The coil spring 29 (see FIG. 8B) is configured to bias the head bracket 27 and the thermal head 28 toward the platen roller 10 when the opening and closing cover 3 is closed. The coil spring 29 is disposed on the rear side of the head bracket 27 (namely, the rear side of the mounting faces of the circuit board 36). The coil spring 29, with the biasing force thereof, presses the head bracket 27 toward the platen roller 10. Thus, the platen shaft 10*a* fitted into the groove 27*b* of the head bracket 27 is pressed firmly. Thereby, the holding of the opening and closing cover 3 by the head bracket 27 is maintained.

As illustrated in FIG. 8B, the pressing part 3*a* of the opening and closing cover 3 is located at a gap between the eave 4*cp* and the plate spring 4*da* of the switching unit 4 in the separation ejection. The pressing part 3*a* comes in contact with and presses the plate spring 4*da* downward so as to press the switching unit 4. Thus, the switching unit 4 is fixed at the separation ejection position, and the separation roller 4*a* of the switching unit 4 is biased toward the platen roller 10. Therefore, the separation roller 4*a* of the switching unit 4 can be biased stably toward the platen roller 10 in the separation ejection mode.

Figure 9:
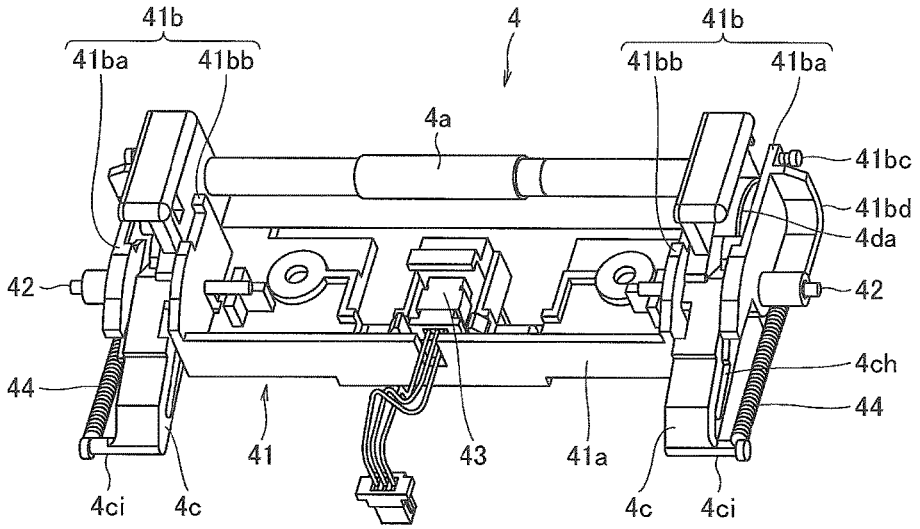
FIG. 9 is a perspective view showing the switching unit and the support board at the continuous ejection position.
Figure 10:
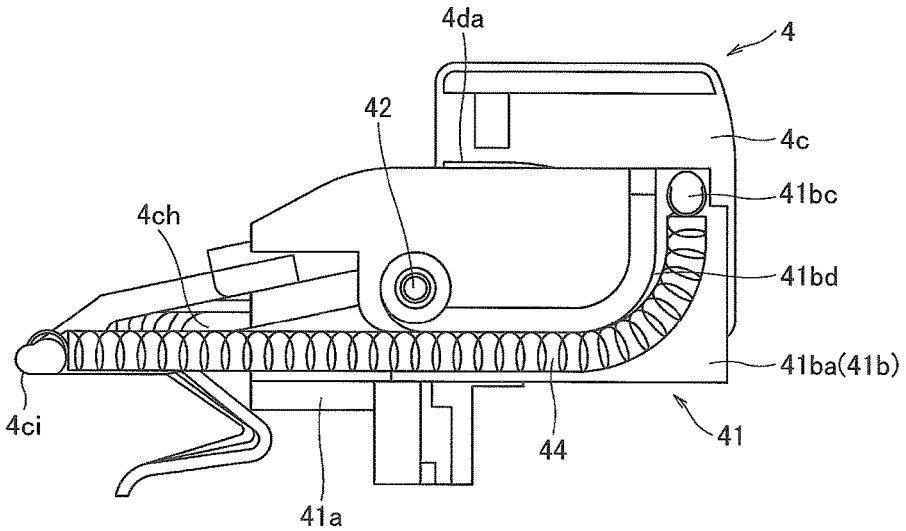
FIG. 10 is a lateral view of the switching unit and the support board of FIG. 9.
Figure 11:
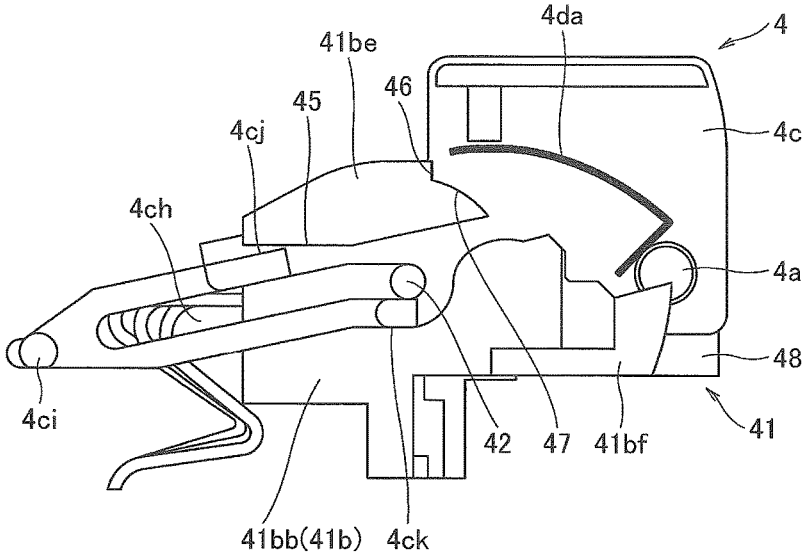
FIG. 11 shows the relationship between the components disposed on the face of a first attachment piece opposed to a second attachment piece at the support board of FIG. 9 and the switching unit.

Referring now to FIGS. 9 to 11, the support board 41 to which the switching unit 4 is mounted will be described below. FIG. 9 is a perspective view showing the switching unit and the support board at the continuous ejection position. FIG. 10 is a lateral view of the switching unit and the support board of FIG. 9. FIG. 11 shows the relationship between the components disposed on the face of a first attachment piece opposed to a second attachment piece at the support board of FIG. 9 and the switching unit.

The support board 41 is disposed in the body case 2. The support board 41 has a base 41*a*. A separation sensor 43 is disposed at the base 41*a*. The separation sensor 43 is a light-reflective type sensor configured to detect presence or absence of the separation roller 4*a* at the rear side thereof and also detect presence or absence of the label PL in the separation ejection mode.

At both ends in the width direction of the base 41*a*, a pair of unit attachment parts 41*b* configured to attach the switching unit 4 is disposed.

Each of the unit attachment parts 41*b* includes: a first attachment piece 41*ba* located outside in the width direction of the base 41*a*, and a second attachment piece 41*bb* located inside in the width direction of the base 41*a*. This second attachment piece 41*bb* faces the first attachment piece 41*ba*. A gap in the lateral direction is formed between the first attachment piece 41*ba* and the second attachment piece 41*bb*. The supporter 4*c* of the switching unit 4 is disposed at the gap and sandwiched between the first attachment piece 41*ba* and the second attachment piece 41*bb*.

At each of the unit attachment parts 41*b*, a shaft 42 is mounted so as to extend between the first attachment piece 41*ba* and the second attachment piece 41*bb*. The shaft 42 is inserted into the guide rail hole 4*ch* that is formed at the supporter 4*c*. The supporter 4*c* is sandwiched between the first attachment piece 41*ba* and the second attachment piece 41*bb*. That is, the guide rail hole 4*ch* engages with the shaft 42.

Therefore, the switching unit 4 can slide with respect to the shaft 42 along the guide rail hole 4*ch*. Further, the switching unit 4 can swing about the shaft 42.

As illustrated in FIGS. 9 and 10, a coil spring 44 is mounted between the switching unit 4 and the support board 41. One end of the coil spring 44 is fixed to an attachment protrusion 41*bc* that is disposed at the rear end of the first attachment piece 41*ba* of the unit attachment part 41*b*. A guide eave 41*bd* is formed to bend like a substantially L-letter shape on a lateral face of the first attachment piece 41*ba*. The coil spring 44 extends forward in a curve from the attachment protrusion 41*bc* along the guide eave 41*bd*. The other end of the coil spring 44 is attached to an attachment protrusion 4*ci* that is disposed on the front end of the supporter 4*c*.

With the coil spring 44, a biasing force is applied to the switching unit 4 in such a direction that an end of the guide rail hole 4*ch* on the attachment protrusion 4*ci* side comes into contact with the shaft 42 (namely, a direction opposite to the continuous ejection position). With the coil spring 44, a biasing force is also applied to the switching unit 4 so as to swing about the end of the guide rail hole 4*ch* on the attachment protrusion 4*ci* side, which contacts with the shaft 42, in such a direction that the switching unit 4 is further spaced apart from the thermal head 28 (an example of the first rotation direction). That is, with the coil spring 44, the switching unit 4 is given two biasing forces, i.e. a biasing force with which the switching unit 4 slides and a biasing force with which the switching unit 4 swings in the first rotation direction.

Thereby, after the setting at the continuous ejection position is cancelled by the release levers 19, the biasing force of the coil spring 44 causes the switching unit 4 to slide in the opposite direction to the continuous ejection position. Then, the end of the guide rail hole 4*ch* on the attachment protrusion 4*ci* side comes into contact with the shaft 42 (at a slide movement position). The switching unit 4 then swings about the shaft 42 in the first rotation direction to a predetermined swing end (namely, a swing end position).

As illustrated in FIG. 11, the supporter 4*c* of the switching unit 4 includes a first claw 4*cj* and a second claw 4*ck*. The first claw 4*cj* is located above the guide rail hole 4*ch*. The second claw 4*ck* is located below the guide rail hole 4*ch*. On a face of the first attachment piece 41*ba* opposed to the second attachment piece 41*bb*, a first protrusion 41*be* and a second protrusion 41*bf* are disposed.

The first protrusion 41*be* has a guide surface 45. When the switching unit 4 slides from the continuous ejection position to the opposite side thereof along the shaft 42, the first claw 4*cj* slides along the guide surface 45 so as to guide the movement direction of the switching unit 4. The first protrusion 41*be* has a first stopper 46. The first stopper 46 is configured to come in contact with the first claw 4*cj* to define the swing end position, when the switching unit 4 swings about the shaft 42 in the first rotation direction as described above. The first protrusion 41*be* has a restriction surface 47. When the switching unit 4 swings from the swing end position, in a second rotation direction opposite to the first rotation direction, to move to the separation ejection position, the restriction surface 47 is configured to restrict slide movement of the first claw 4*cj* and restrict movement of the switching unit 4 to return to the continuous ejection position.

When the first claw 4*cj* comes in contact with the first stopper 46 and thereby the switching unit 4 is at the swing end position, an end of the switching unit 4 that is opposed to the opening and closing cover 3 (namely, a rear end of the switching unit 4) is within the swing trajectory of the opening and closing cover 3.

Meanwhile, the second protrusion 41*bf* has a second stopper 48. When the switching unit 4 is set at the separation ejection position, the second claw 4*ck* comes in contact with the second stopper 48, thereby restricting movement of the switching unit 4 to return to the continuous ejection position.

Figure 12A:
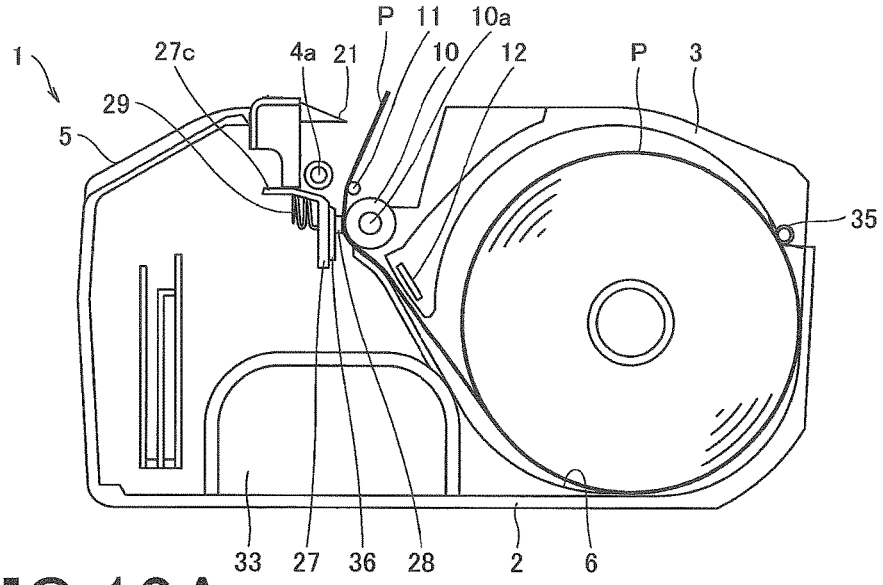
FIG. 12A is a schematic section view of the printer shown in FIG. 1A in the continuous ejection mode.
Figure 12B:
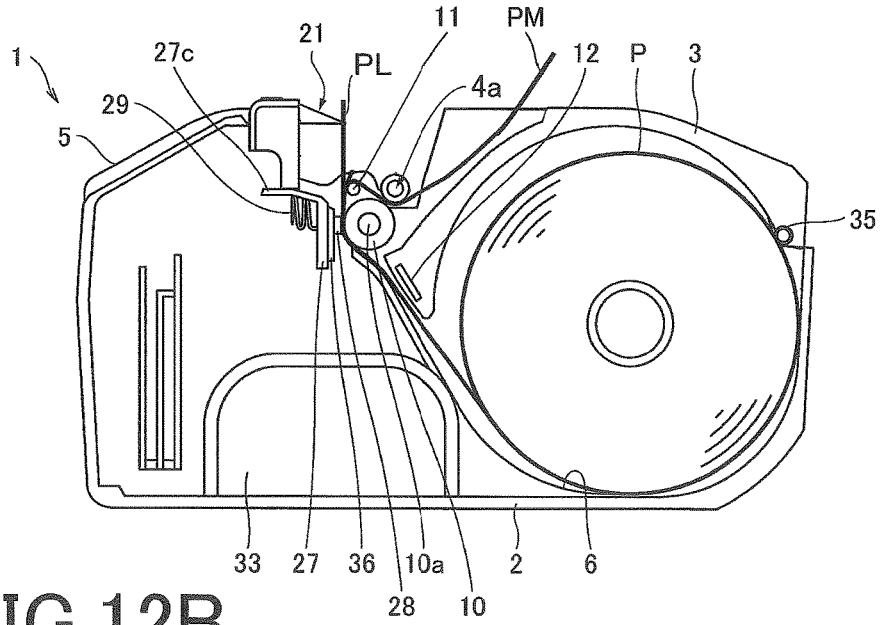
FIG. 12B is a schematic section view of the printer shown in FIG. 1B in the separation ejection mode.

Referring now to FIGS. 12A and 12B, continuous ejection and separation ejection of the printer 1 will be described. FIG. 12A is a schematic section view of the printer shown in FIG. 1A in the continuous ejection mode. FIG. 12B is a schematic section view of the printer shown in FIG. 1B in the separation ejection mode.

In both of the continuous ejection mode and the separation ejection mode, at the printing step, while the continuous paper P extracted from the paper container 6 is pinched between the thermal head 28 and the platen roller 10, the platen roller 10 is rotated to feed the continuous paper P. During the feeding, print timing is determined based on the information detected by the sensors 12. Then heat is selectively generated at the heater resistors of the thermal head 28 in accordance with the print signals transmitted to the thermal head 28 at the determined print timing, whereby desired information is printed on the labels PL of the continuous paper P.

In the case of the continuous ejection, as illustrated in FIG. 12A, the switching unit 4 is located at the continuous ejection position inside of the printer 1. The printed label PL is then ejected without being separated from the mount PM. In the case of the continuous ejection, the mount PM with a required number of label(s) PL attached thereon is cut off with the cutter 21. Then, the operator brings this cut-off mount PM to the site and separates the label(s) PL from the mount PM for attachment at the site. Therefore, the continuous ejection mode is suitable for the case where a target for attachment of the label PL is away from the printer 1.

As illustrated in FIG. 12A, when the switching unit 4 is set at the continuous ejection position, the separation roller 4*a* is stored inside of the body case 2. Thus, the separation roller 4*a* does not stick out from the body case 2, which prevents the hands of the operator from coming into contact with the separation roller 4*a*. Therefore, deterioration of the separation roller 4*a* can be prevented.

Meanwhile, as shown in FIG. 12B, when the operator intends to operate in the separation ejection, he or she sets the switching unit 4 at the separation ejection position and causes the mount PM to be pinched between the separation roller 4*a* of the switching unit 4 and the platen roller 10 via the separation pin 11. Thereby, when the platen roller 10 is rotated to feed the continuous paper P for printing, the mount PM is fed while being pinched between the separation roller 4*a* and the platen roller 10. The printed labels PL are separated from the mount PM one by one, and are ejected from the printer 1. Because the labels PL are ejected one by one in the case of the separation ejection, the separation ejection is suitable for the case where a target for attachment of the labels PL is located near the operator.

Figure 13:
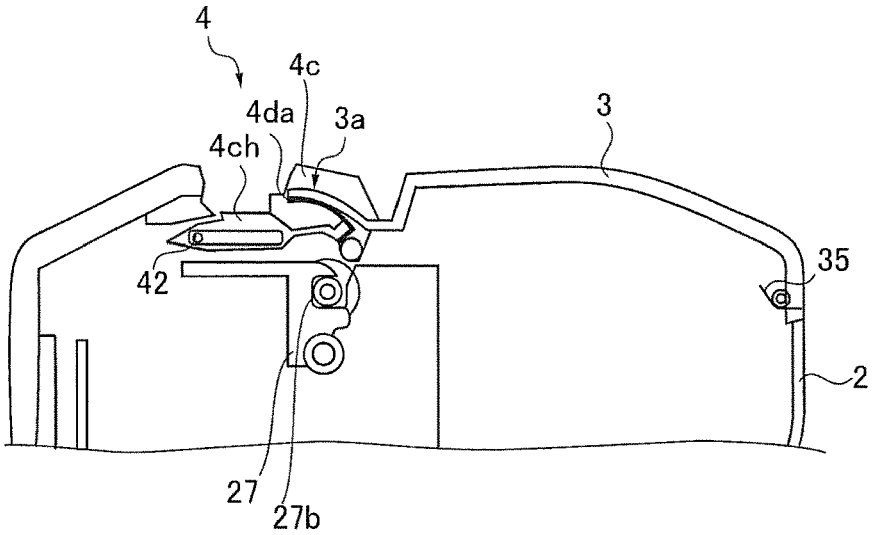
FIG. 13 shows a schematic section view of the major components of the printer when the mode of the printer is changed from the separation ejection mode to the continuous ejection mode.
Figure 13:
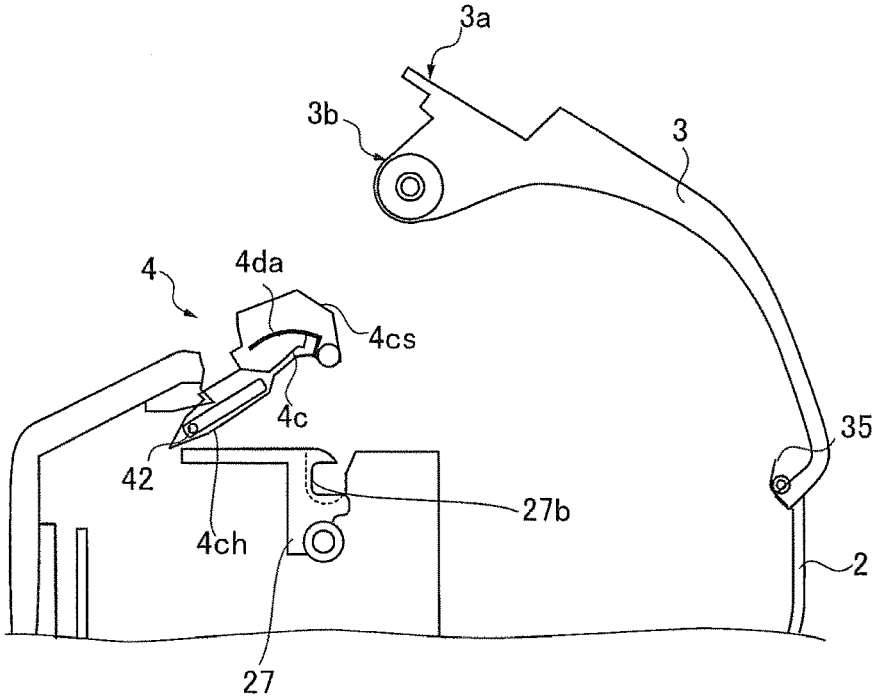
Figure 14:
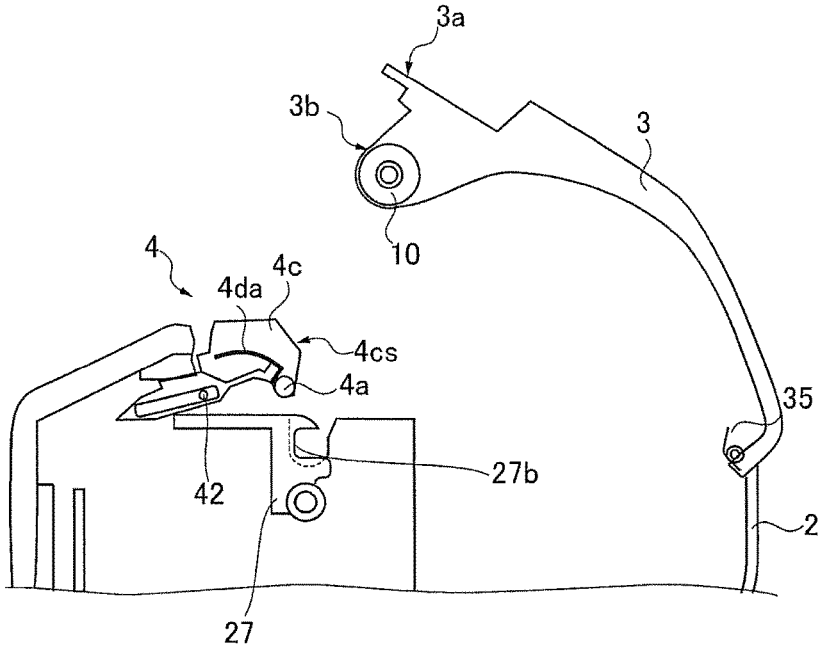
FIG. 14 shows a schematic section view of the major components of the printer when the mode of the printer is changed from the separation ejection mode to the continuous ejection mode.
Figure 14:
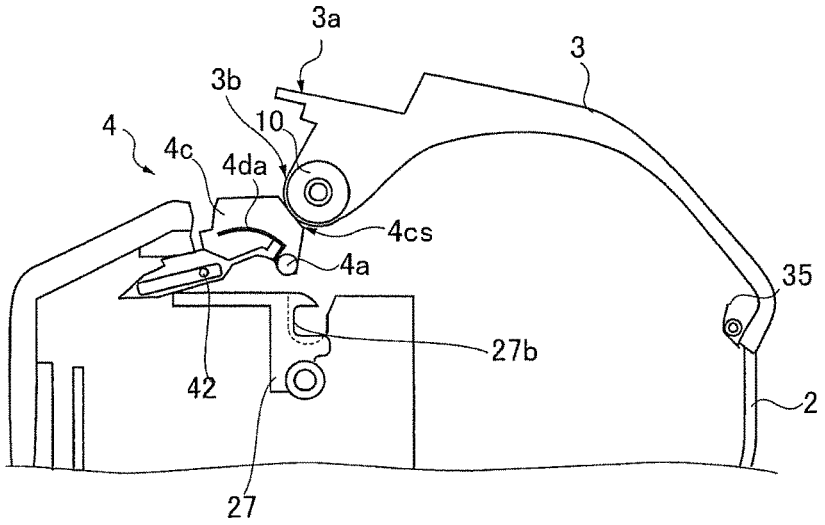
Figure 15:
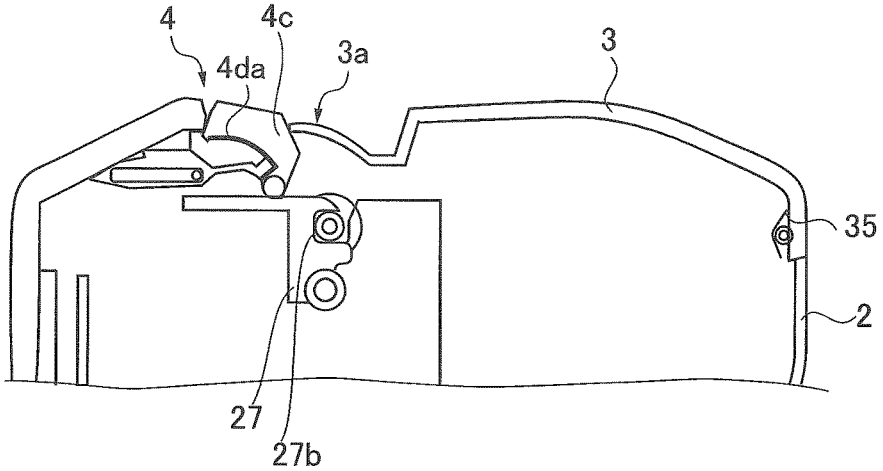
FIG. 15 shows a schematic section view of the major components of the printer when the mode of the printer is changed from the separation ejection mode to the continuous ejection mode.

Referring now to FIGS. 13 to 15, a series of processes in changing from the separation ejection mode to the continuous ejection mode in the printer 1 according to the present embodiment will be described. Each of statuses S1 to S5 of FIGS. 13 to 15 shows a schematic section view of the major components of the printer 1 when the mode of the printer 1 is changed from the separation ejection mode to the continuous ejection mode.

Note that the opening and closing cover 3 in the statuses S1 and S5 is illustrated in a different manner from that in the statuses S2 to S4 for the sake of easiness of understanding.

The status S1 of FIG. 13 shows the status of the printer 1 in the separation ejection mode. In this status, the platen shaft 10*a* of the platen roller 10, which is pivotally supported at the opening and closing cover 3, is fitted into the groove 27*b* of the head bracket 27, and thereby the opening and closing cover 3 is held. The separation roller 4*a* of the switching unit 4 is biased by the platen roller 10 that is attached to the opening and closing cover 3, and the switching unit 4 is set at the separation ejection position.

When the operator pushes the cover-open button 18 in the status S1, the holding of the platen shaft 10*a* by the head bracket 27 is cancelled. Thus, as illustrated in the status S2, a status of the opening and closing cover 3 is changed to the opened status by a biasing force of the torsion spring 35. In the separation ejection mode, the supporter 4*c* of the switching unit 4 does not engage with the claw 19*a*, and thus movement of the switching unit 4 is not restricted by the release lever 19. With the change to the opened status of the opening and closing cover 3, engagement of the unit pressing part 3*a* of the opening and closing cover 3 with the plate spring 4*da* of the switching unit 4 is cancelled. Thereby, with a biasing force of the coil spring 44, the switching unit 4 swings about the shaft 42 in the first rotation direction, to the swing end position.

Next, the operator pushes the switching unit 4 forward in the printer 1 in order to set the switching unit 4 at the continuous ejection position. When the switching unit 4 is set at the continuous ejection position, both of the pair of supporters 4*c* of the switching unit 4 are held by the pair of the release levers 19. However, variation in the pushing force by the operator to the pair of supporters 4*c* of the switching unit 4 or the like may lead to a situation in which only one of the pair of the supporters 4*c* is held by the release lever 19 and the other of the pair of the supporters 4*c* is not held by the release lever 19. The status S3 of FIG. 14 represents such situation. In the status S3, the switching unit 4 is not completely set at the continuous ejection position.

Then, as illustrated in the status S4 of FIG. 14, when the operator pushes the opening and closing cover 3 so as to be closed in order to perform the continuous ejection, the unit contact portion 3*b* of the opening and closing cover 3, which is disposed in the vicinity of both ends of the platen roller 10, comes into contact with the inclined surface 4*cs* of the supporter 4*c* of the switching unit 4, due to a rotational action of the opening and closing cover. By continuously applying the pushing force for the opening and closing cover 3 to the pair of inclined surfaces 4*cs* of the switching unit 4, the pushing force causes the switching unit 4 to slide forward to the continuous ejection position. That is, when the opening and closing cover 3 is pushed down, the pair of unit contact portions 3*b* of the opening and closing cover 3 respectively slides on the pair of inclined surfaces 4*cs* of the switching unit 4, and thereby the switching unit 4 slides to the continuous ejection position in accordance with movement of the opening and closing cover 3. Since the supporter 4*c* of the switching unit 4 that is not held in the status S3 is now pushed forward, this supporter 4*c* also becomes held by the release lever 19.

When the both of the pair of the supporters 4*c* of the switching unit 4 are respectively held by the pair of release levers 19, the switching unit 4 is set at the continuous ejection position and stops sliding.

As the opening and closing cover 3 is pushed down further to rotate, the platen shaft 10*a* attached to the opening and closing cover 3 causes the head bracket 27 to swing against a biasing force of the coil spring 29. Consequently, the platen shaft 10*a* is held by the head bracket 27. As illustrated in the status S5 of FIG. 15, the opening and closing cover 3 is closed and the printer 1 comes into the continuous ejection mode. In the continuous ejection mode, one end of the guide rail hole 4*ch* contacts the shaft 42 against a biasing force of the coil spring 44, and the separation roller 4*a* is at a position so as not to face the platen roller 10.

Figure 16:
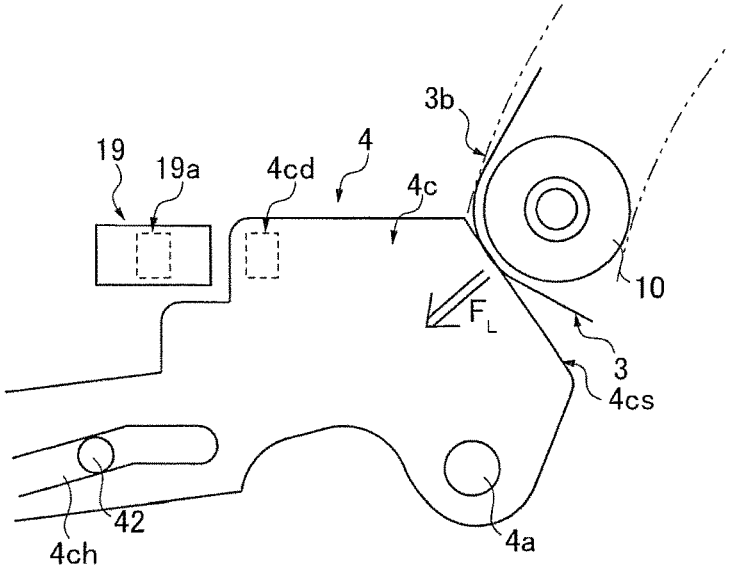
FIG. 16 shows a relation between the opening and closing cover and the switching unit when the switching unit is going to be set at the continuous ejection position sequentially.
Figure 16:
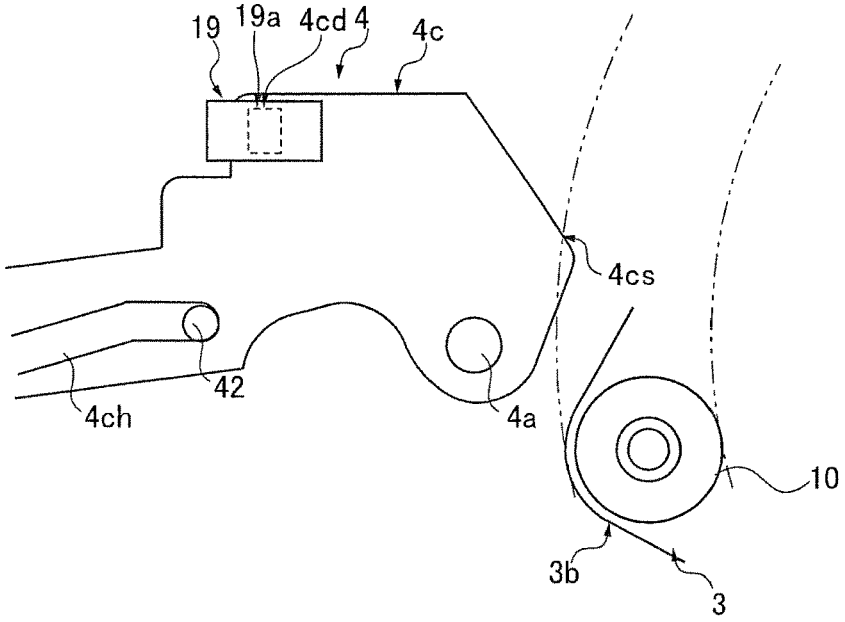
Figure 17:
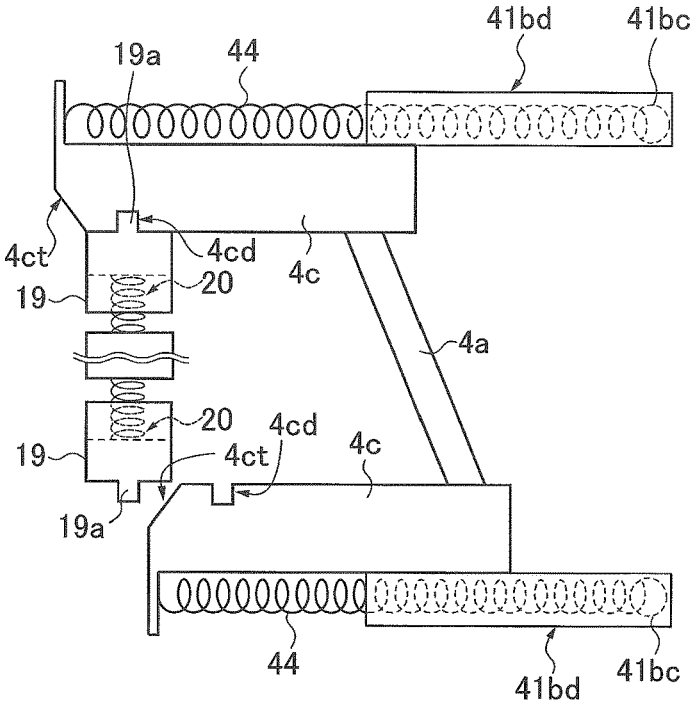
FIG. 17 shows a relation between the switching unit and a pair of release levers from the plan view sequentially.
Figure 17:
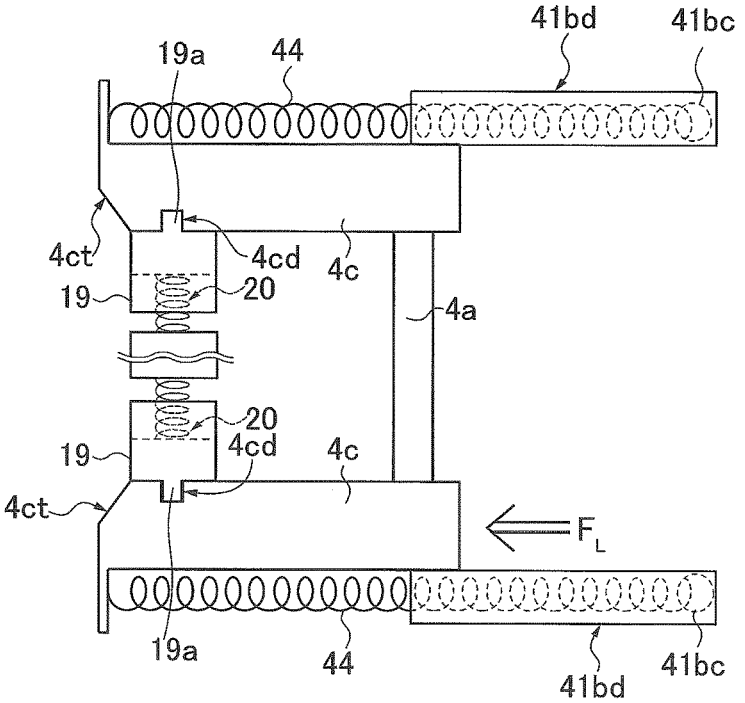

Next, with reference to FIGS. 16 and 17, actions of the opening and closing cover 3 and the switching unit 4 during a period from the status S4 of FIG. 14 until the status S5 of FIG. 15, will be described in detail. FIG. 16 shows a relation between the opening and closing cover 3 and the switching unit 4 when the switching unit 4 is going to be set at the continuous ejection position, in the statuses S4 and S5 sequentially. FIG. 17 shows a relation between the switching unit 4 and the pair of release levers 19 from the plan view, in the statuses S4 and S5 sequentially.

The statuses S4 and S5 in FIGS. 16 and 17 corresponds to those statuses in FIGS. 14 and 15 respectively.

In the status S4 of FIG. 16, similarly to the status S4 of FIG. 14, the unit contact portions 3*b* of the opening and closing cover 3, which is formed in the vicinity of the both ends of the platen roller 10, comes into contact with the inclined surface 4*cs* of the supporter 4*c* of the switching unit 4. At this time, as illustrated in the status S4 of FIG. 17, one of the pairs of supporters 4*c* is held by one of the pair of release levers 19, while the other of the pairs of supporters 4*c* is not held by the other of the pair of release levers 19. That is, the pair of supporters 4*c* is at an incomplete continuous ejection position (an example of the second position).

Referring now to FIG. 17, action of holding the pair of supporters 4*c* by the pair of release levers 19 will be described below. The pair of release levers 19 is provided with a pair of coil springs 20 that biases the pair of release levers 19 respectively outward along a direction in which the pair of release levers 19 is operated. When the switching unit 4 slides forward, firstly, a chamfered surface 4*ct*, which is formed at the front end of the supporter 4*c* of the switching unit 4, comes into contact with the claw 19*a* of the release lever 19, and then causes the release lever 19 to move inward against the biasing force of the coil spring 20. The switching unit 4 slides forward further, and the recess 4*cd* of the supporter 4*c* reaches a position of the claw 19*a* of the release lever 19. Consequently, the claw 19*a* engages with the recess 4*cd*, and the supporter 4*c* is held by the release lever 19.

Assume a case in which one of the pair of supporters 4*c* is not held by the release lever 19 in the status S4 of FIG. 16. In such case, a pushing force F acts on the inclined surface 4*cs* of the one of the pair of supporters 4*c* (in other words, the inclined surface 4*cs* that is positioned more rearward and closer to the unit contact portion 3*b*), due to an operation to the opening and closing cover 3 by the operator. A component force $F_L$ (see FIG. 17) of the force F causes the supporter 4*c* to slide in a direction from the separation ejection position to the continuous ejection position and along the guide rail hole 4*ch*. With the operation to the opening and closing cover 3 by the operator, the unit contact portion 3*b* of the opening and closing cover 3 continues to contact the inclined surface 4*cs* of the one of the pair of supporters 4*c*, and the component force $F_L$ continues to act on the inclined surface 4*cs* of the one of the pair of supporters 4*c*. Thereby, the supporter 4*c* which is not held by the release lever 19 in the status S4 slides along the guide rail hole 4*ch*. Finally, the recess 4*cd* of the supporter 4*c* which is not held by the release lever 19 in the status S4 comes to engage with the claw 19*a* of the release lever 19, and the supporter 4*c* comes to be held by the release lever 19. That is, the pair of supporters 4*c* comes to be set at the continuous ejection position (an example of the second position).

As described above, in the printer 1 according to the present embodiment, the unit contact portion 3*b* of the opening and closing cover 3 comes into contact with the inclined surface 4*cs* of the switching unit 4, and thereby the switching unit 4 moves in a direction from the separation ejection position to the continuous ejection position, in accordance with the status change in the opening and closing cover 3 from the opened status to the closed status. As described above, when the operator pushes the switching unit 4 forward so as to set at the continuous ejection position, in an attempt to switch the printer 1 from the separation ejection mode to the continuous ejection mode, there may be a situation in which one or both of the pairs of supporters 4*c* is not pushed enough to be held by the release levers 19. Even in such situation, by closing the opening and closing cover 3, both of the supporters 4*c* come to be held by the release levers 19. Consequently, the switching unit 4 can be surely set at the continuous ejection position. Even in the case in which the operator thinks that he or she has set the switching unit 4 at the continuous ejection position, but actually the switching unit 4 is not set at the continuous ejection position completely, he or she can set the switching unit 4 at the continuous ejection position merely by closing the opening and closing cover 3. That is, the unit contact portion 3*b* of the opening and closing cover 3 and the inclined surface 4*cs* of the switching unit 4 serve to assist the operator to surely set the switching unit 4 at the continuous ejection position.

If the switching unit 4 was not provided with the inclined surface 4*cs*, the above-described component force $F_L$ would not be obtained by the operation of the operator with respect to the opening and closing cover 3, and thus, as illustrated in the status S4 of FIG. 17, the switching unit 4 would be set at an incomplete continuous ejection position where only one of the pair of supporters 4*c* is held by the release lever 19. At the incomplete continuous ejection position, the opening and closing cover 3 cannot be closed completely, or, even if the opening and closing cover 3 can be closed, a trouble may occur when the mount is cut with the cutter 21. That is, as illustrated in the status S4 of FIG. 17, the rear end of the supporter 4*c* that is not held by the release lever 19 is positioned more rearward than the rear end of the other supporter 4*c*, and may be positioned even more rearward than the cutter 21. Therefore, the cutter 21 may not be able to cut the mount properly. In other aspect, as illustrated in the status S4 of FIG. 17, when one of the supporters 4*c* is not held by the release lever 19, the separation roller 4*a* is wholly located rearward. Then, a trouble may occur that the separation sensor 43 is not able to detect the separation roller 4*a*, and thus an ejection mode is not properly determined.

In contrast, in the printer 1 according to the present embodiment, with the inclined surfaces 4*cs* provided at the switching unit 4, the switching unit 4 can be surely set at the continuous ejection position, and thereby the above-mentioned trouble(s) are prevented.

In an example of the embodiment described above, the inclined surface 4*cs* of the switching unit 4 is arranged to be a flat surface; however, other example may be applied. An inclined surface of any shape may be applied as long as the unit contact portion 3*b* contacts the inclined surface 4*cs* of the switching unit 4 and thereby the switching unit 4 is caused to move to the continuous ejection position. For example, the inclined surface may be a concave or a convex curbed surface, or may include a plurality of flat surfaces that form a polygonal shape in section.

Although the present embodiment describes the case using a label continuous paper including a plurality of labels temporarily adhering to a mount as a print medium, the present invention is not limited to this embodiment. For instance, a label continuous body (mountless label) having one face as an adhesive face or a continuous sheet without an adhesive face as well as film which can be printed with a thermal head instead of paper may be used as the print medium. The mountless label, the continuous sheet or the film may have location detection marks thereon. In order to feed a mountless label that exposes adhesive agent, the feeding path may be coated with non-adhesive and a non-adhesive roller containing silicone may be used.

The invention claimed is:

1. A printer feeding a belt-shaped mount to which a print medium temporarily adheres, the printer comprising:

a body case;

a container configured to contain a roll body into which the belt-shaped mount is wound;

an opening and closing cover configured to open or close the container;

a switching unit configured to be movable between a first position and a second position; and a spring configured to bias the switching unit in a direction from the second position to the first position, a first end of the spring being coupled to the body case, and a second end of the spring being coupled to the switching unit, wherein, when the switching unit is at the first position, printing is performed with a first ejection mode in which a printed print medium is separated from the belt-shaped mount, and when the switching unit is at the second position, printing is performed with a second ejection mode in which a printed print medium is not separated from the belt-shaped mount, and wherein a portion of the opening and closing cover contacts the switching unit against a biased force to the switching unit such that the switching unit moves until reaching the second position, in response to a status change of the opening and closing cover from an opened status to a closed status.

2. The printer according to claim 1, wherein the portion of the opening and closing cover contacts the switching unit such that the switching unit moves in a direction from an incomplete second position toward the second position, in response to the status change of the opening and closing cover from the opened status to the closed status.

3. The printer according to claim 2, further comprising a pair of holders configured to be capable of holding the switching unit at the second position, wherein the switching unit includes a pair of supporters, and the incomplete second position is a position in which only one of the pair of supporters is held at the second position.

4. The printer according to claim 3, wherein the switching unit includes an inclined surface that is inclined in a direction from the incomplete second position to the second position, and wherein the portion of the opening and closing cover contacts the inclined surface while the opening and closing cover rotates in association with the status change of the opening and closing cover from the opened status to the closed status, thereby moving the switching unit in said direction.

5. The printer according to claim 3, wherein each of the pair of supporters includes a recess, and each of the pair of holders includes a claw engaging with the recess.

6. The printer according to claim 3, wherein the switching unit includes an inclined surface that is inclined in a direction from the incomplete second position to the second position, wherein the portion of the opening and closing cover contacts the inclined surface while the opening and closing cover rotates in association with the status change of the opening and closing cover from the opened status to the closed status, thereby moving the switching unit in said direction, and wherein each of the pair of supporters includes a recess, and each of the pair of holders includes a claw engaging with the recess.

7. The printer according to claim 2, wherein the switching unit includes an inclined surface that is inclined in a direction from the incomplete second position to the second position, and wherein the portion of the opening and closing cover contacts the inclined surface while the opening and closing cover rotates in association with the status change of the opening and closing cover from the opened status to the closed status, thereby moving the switching unit in said direction.

8. The printer according to claim 7, wherein each of the pair of supporters includes a recess, and each of the pair of holders includes a claw engaging with the recess.

9. The printer according to claim 1, further comprising a platen roller configured to feed the belt-shaped mount, the platen roller attached to the opening and closing cover, wherein the portion of the opening and closing cover is in the vicinity of the both ends of the platen roller.

10. The printer according to claim 9, wherein the switching unit comprises a separation roller, and wherein in the first ejection mode, the belt-shaped mount is pinched between the separation roller and the platen roller to separate the printed print medium from the belt-shaped mount.

11. The printer according to claim 10, wherein when the switching unit is in the second position, the separation roller is stored within the container such that the separation roller is not exposed to an exterior of the container, and wherein when the switching unit is in the first position, the separation roller protrudes from the container such that the separation roller is exposed to the exterior of the container.

12. The printer according to claim 1, further comprising a lock mechanism configured to lock to prevent the switching unit from moving, and to unlock to release the switching unit.

13. The printer according to claim 12, wherein when the lock mechanism is locked, the switching unit is at the second position and prevented from moving, and wherein when the lock mechanism is unlocked, the switching unit moves toward the first position from the second position.

14. The printer according to claim 12, wherein the switching unit comprises a separation roller pivotally and rotatably supported at a shaft sandwiched between a pair of supporters, and wherein the lock mechanism comprises a claw configured to be received in a recess of a supporter to prevent the switching unit from moving.

15. The printer according to claim 1, further comprising a support board disposed in the body case, wherein the first end of the spring is coupled to the support board.

16. A printer feeding a belt-shaped mount to which a print medium temporarily adheres, the printer comprising:

a container configured to contain a roll body into which the belt-shaped mount is wound;

an opening and closing cover configured to open or close the container;

a switching unit configured to be movable between a first position and a second position; and a spring configured to bias the switching unit in a direction from the second position to the first position, wherein, when the switching unit is at the first position, printing is performed with a first ejection mode in which a printed print medium is separated from the belt-shaped mount, and when the switching unit is at the second position, printing is performed with a second ejection mode in which a printed print medium is not separated from the belt-shaped mount, wherein a portion of the opening and closing cover contacts the switching unit against a biased force to the switching unit such that the switching unit moves until reaching the second position, in response to a status change of the opening and closing cover from an opened status to a closed status, and wherein the switching unit is biased to swing in a rotational direction from the second position to the first position.

17. A printer feeding a belt-shaped mount to which a print medium temporarily adheres, the printer comprising:

a container configured to contain a roll body into which the belt-shaped mount is wound;

an opening and closing cover configured to open or close the container;

a switching unit configured to be movable between a first position and a second position; and a spring configured to bias the switching unit in a direction from the second position to the first position, wherein, when the switching unit is at the first position, printing is performed with a first ejection mode in which a printed print medium is separated from the belt-shaped mount, and when the switching unit is at the second position, printing is performed with a second ejection mode in which a printed print medium is not separated from the belt-shaped mount, wherein a portion of the opening and closing cover contacts the switching unit against a biased force to the switching unit such that the switching unit moves until reaching the second position, in response to a status change of the opening and closing cover from an opened status to a closed status, and wherein the spring is configured to apply, to the switching unit, a first biasing force in a lateral direction and a second biasing force in a rotational direction.

* * * * *